US005802649A

United States Patent [19]

Threlkeld

[11] Patent Number: 5,802,649

[45] Date of Patent: Sep. 8, 1998

[54] METHOD AND APPARATUS FOR DYEING A TRAVELING TEXTILE STRAND

[75] Inventor: James O. Threlkeld, Charlotte, N.C.

[73] Assignee: FYPRO, Charlotte, N.C.

[21] Appl. No.: 916,072

[22] Filed: Aug. 21, 1997

Related U.S. Application Data

[63] Continuation of Ser. No. 599,800, Feb. 12, 1996, abandoned.

[51] Int. Cl.[6] ..... D06B 5/06; D06B 15/00

[52] U.S. Cl. ..... 8/151.2; 68/19; 68/19.1

[58] Field of Search ..... 8/149.1, 151.2, 8/933; 68/5 D, 19, 19.1; 34/113, 624, 657

[56] References Cited

U.S. PATENT DOCUMENTS

| | | | |
|---|---|---|---|
| 151,694 | 6/1874 | Garsed et al. . | |
| 1,568,959 | 1/1926 | Chase et al. . | |
| 1,823,258 | 9/1931 | Cramer et al. . | |
| 1,907,898 | 5/1933 | Taylor . | |
| 2,246,735 | 6/1941 | Kline et al. . | |
| 2,302,620 | 11/1942 | Lovett . | |
| 2,303,274 | 11/1942 | Herrstrom et al. . | |
| 2,367,730 | 1/1945 | Masland, II . | |
| 2,750,250 | 6/1956 | Lindenstruth . | |
| 2,769,727 | 11/1956 | Bowen et al. . | |
| 2,804,764 | 9/1957 | Runton . | |
| 2,885,878 | 5/1959 | Kocay et al. . | |
| 3,088,792 | 5/1963 | Mathis, Jr. . | |
| 3,164,650 | 1/1965 | Kocay et al. | 34/113 X |
| 3,180,004 | 4/1965 | Fisher et al. . | |
| 3,287,888 | 11/1966 | Chidgey . | |
| 3,414,957 | 12/1968 | Langstaff et al. . | |
| 3,533,145 | 10/1970 | Fleissner . | |
| 3,579,766 | 5/1971 | Feinberg . | |
| 3,585,821 | 6/1971 | Beltramini . | |
| 3,751,778 | 8/1973 | Grosjean et al. . | |
| 3,783,596 | 1/1974 | Waldkirch . | |
| 3,800,565 | 4/1974 | Worth et al. | 68/5 D |
| 3,808,792 | 5/1974 | Arimoto et al. . | |
| 3,847,544 | 11/1974 | Quynn . | |
| 3,883,302 | 5/1975 | Amend . | |
| 3,893,806 | 7/1975 | Finch et al. . | |
| 3,908,247 | 9/1975 | Murphy . | |
| 3,908,408 | 9/1975 | Getchell et al. | 68/19 X |
| 3,919,749 | 11/1975 | McWhirter et al. . | |
| 3,921,377 | 11/1975 | Snyder . | |
| 3,973,908 | 8/1976 | Dunn, Jr. . | |
| 4,031,596 | 6/1977 | Joy . | |
| 4,178,705 | 12/1979 | Birke et al. . | |
| 4,299,015 | 11/1981 | Marcus et al. . | |
| 4,329,750 | 5/1982 | Binnersley . | |
| 4,452,605 | 6/1984 | Love . | |
| 4,452,607 | 6/1984 | Wessely . | |
| 4,468,921 | 9/1984 | Shilbata et al. . | |
| 4,497,099 | 2/1985 | Scott . | |
| 4,574,578 | 3/1986 | Scott . | |
| 4,685,284 | 8/1987 | Phillipp et al. . | |
| 5,070,585 | 12/1991 | Enderlin . | |
| 5,385,584 | 1/1995 | Teramura et al. . | |

FOREIGN PATENT DOCUMENTS

| | | | |
|---|---|---|---|
| 29 11 38 B1 | 8/1980 | Germany . | |
| 3325958 | 2/1985 | Germany | 8/149.1 |
| 861035 | 2/1961 | United Kingdom . | |
| 1 253 657 | 11/1971 | United Kingdom . | |
| 2 037 188 | 7/1980 | United Kingdom . | |

OTHER PUBLICATIONS

Textile Chemical Processing, "Continuous Dyeing—Problems and Solutions", pp. 49–51, Mar. 1997.

*Primary Examiner*—Philip R. Coe

*Attorney, Agent, or Firm*—Kennedy Covington Lobdell & Hickman, LLP

[57] ABSTRACT

A method for dyeing a traveling strand of textile yarn includes applying an aqueous dye solution to the yarn, heating the yarn to a temperature less than 100° C. to dry the strand without boiling the water in the dye solution and then heating the strand to a temperature between 120° C. and 220° C. for further thermal treatment of the traveling strand.

20 Claims, 2 Drawing Sheets

METHOD AND APPARATUS FOR DYEING A TRAVELING TEXTILE STRAND

CROSS-REFERENCE TO RELATED APPLICATION

This is a continuation of application Ser. No. 08/599,800, filed Feb. 12, 1996, and now abandoned.

BACKGROUND OF THE INVENTION

The present invention relates broadly to methods for dyeing textile materials and, more specifically, to a method for dyeing a textile strand to prevent dye splatter when using aqueous dye.

During the course of dyeing a textile strand, it typically becomes necessary to heat the strand with the dye thereon in order to set the dye or to cause some other chemical reaction within the dye or between the dye and the strand. Several methods are available for dyeing textile strands, particularly traveling textile strands. According to the basic process used in the present invention, the dye in solution with a polymer or silicone is metered onto the traveling strands so that dye is not wasted. Only a predetermined amount of dye, i.e., that which the strand will fully accept, is applied. The strand is then typically heated to a predetermined temperature within the range of 120° C. to 220° C. to set the dye or cause the aforesaid other chemical reactions to occur.

A problem with this method is that when using an aqueous dye the water within the dye solution is caused to rapidly boil away which can cause dye splatter. As may be expected, the dye splatter causes unsightly disturbances in the textile strand, which are ultimately seen in a finished textile product. It is accordingly desirable to apply the dye and achieve the desired temperature without the resultant dye splatter.

SUMMARY OF THE INVENTION

It is accordingly an object of the present invention to provide a method for dyeing a traveling strand of textile yarn which eliminates the above-discussed dye splatter, thereby enhancing the appearance of yarn dyed in an aqueous dye solution.

To that end, a method for dyeing a traveling strand of textile yarn includes the steps of providing a traveling strand of textile yarn moving along a predetermined path at a predetermined speed; providing an arrangement for applying an aqueous dye to the yarn; applying the aqueous dye to the yarn using the arrangement for applying dye; providing a first assembly for heating the yarn to a first predetermined temperature with the predetermined temperature being less than 100° C.; heating the yarn to the first predetermined temperature using the first heating assembly; providing a second assembly for heating the yarn to a second predetermined temperature with the second predetermined temperature being greater than 100° C. with the second heating arrangement being disposed a predetermined distance downstream of the first heating assembly, heating the yarn to the second predetermined temperature using the second heating assembly and, finally, winding the yarn on a bobbin.

The method of the present invention further preferably includes providing two heated rolls disposed in opposition to one another with the yarn trained alternately around each roll to extend therebetween. It is further preferred that the second assembly for heating the yarn includes providing two second heated rolls disposed in opposition to one another with the yarn trained alternately around each roll to extend therebetween.

According to a second preferred embodiment, the steps of providing first and second arrangements for heating the yarn include providing a single roll having a first heating zone which is heated to a temperature of less than 100° and a second heating zone which is heated to a temperature within the range of 120° C. to 250° C. with the yarn trained therearound.

It is preferred that the step of heating the yarn to the first predetermined temperature includes heating the yarn to a temperature of 90° C. It is further preferred that the step of heating the yarn to its second predetermined temperature includes heating the yarn to a temperature in the range of 120° C. to 250° C.

The step of applying an aqueous dye to the traveling strand preferably includes metering the aqueous dye onto the traveling strand in coordination with the predetermined speed of the traveling strand so that the strand absorbs substantially all the dye applied thereto as it travels by a dye application position along the travel path.

By the above method, a traveling strand of textile material may be dyed in a manner which eliminates the dye splatter associated with boiling away the water in the aqueous dye solution.

DETAILED DESCRIPTION OF THE PREFERRED EMBODIMENTS

Figure 1:
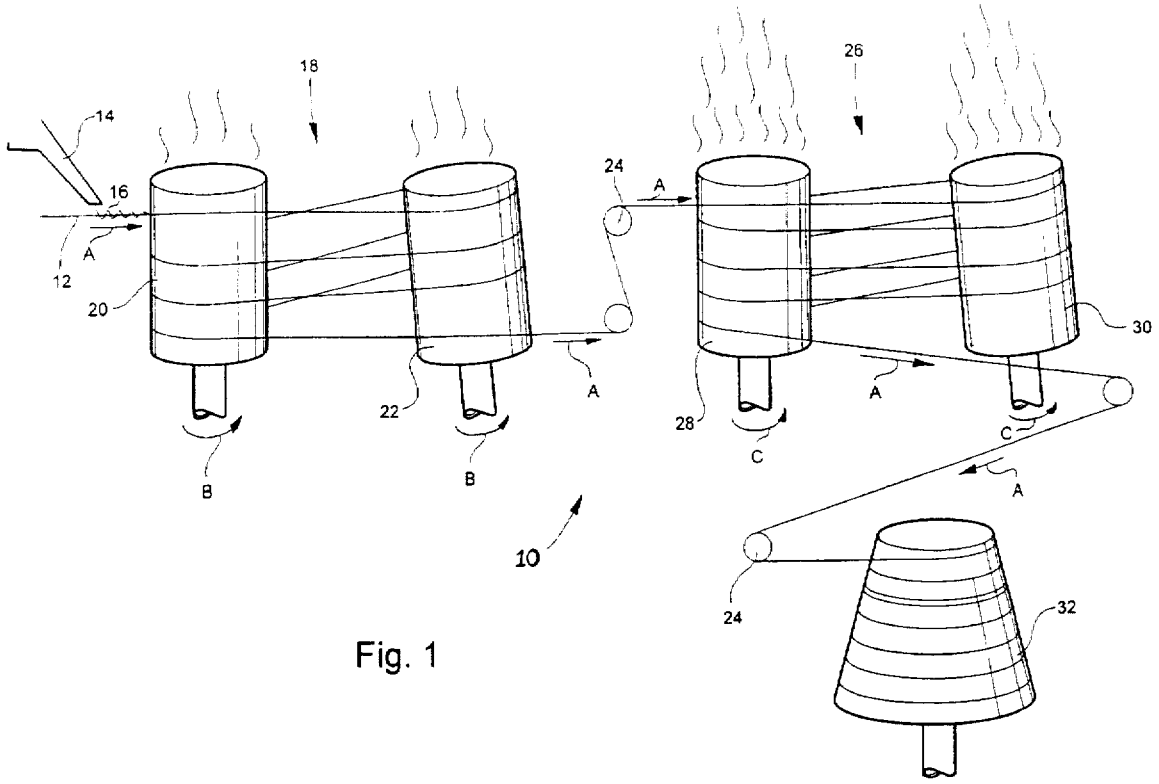
FIG. 1 is a diagrammatic view of an apparatus for carrying out the method according to a first preferred embodiment of the present invention.

Turning now to FIG. 1, an assembly for carrying out the method of the present invention according to the preferred embodiment thereof is depicted generally at 10. It should be noted that the embodiment of the invention depicted in FIG. 1 is merely a diagrammatic form intended to illustrate to those skilled in the art the necessary steps in carrying out the method of the present invention and is not intended to be a detailed analysis of dyeing techniques and the equipment used therein. The illustration is intended to convey the general nature of the equipment needed to carry out the method according to the present invention which will be apparent to those skilled in the art.

According to the method of the present invention, the traveling strand 12 is caused to travel along a predetermined travel path as indicated by arrows A in FIG. 1. Along the travel path, a metering device 14 applies a predetermined amount of dye 16 to the traveling strand which is substantially absorbed by the traveling strand 12. The traveling strand 12 then proceeds to the first heating assembly 18 which comprises two heated rolls 20,22 which are rotatable according to arrows B and spaced a predetermined distance apart with a second roll 22 being at an angular relationship with a first roll 20. The first heating assembly 18 provides rolls 20,22 which are heated to approximately 90° C. The rolls 20,22 are driven, causing the traveling strand 12 to maintain its motion along the path. In FIG. 1, pulleys 24 are illustrated in a general manner in order to maintain the continuity of the traveling strand 12 and are not intended to depict actual pulleys or supplant any equipment between each heating assembly and between the heating assemblies and the bobbin 32 on which the traveling strand 12 is ultimately wound.

A second heating assembly 26 is disposed downstream of the first heating assembly 18 and comprises a pair of spaced rolls 28,30, similar to the first rolls 20,22, which are heated to a temperature of approximately 120° C. to 220° C. The temperature of the second heating assembly is dependent on the nature of the dye and its thermo-chemical requirements. The rolls 28,30 of the second heating assembly are similar to the rolls of the first heating assembly 18 except for the temperature to which they are elevated. The second rolls 28,30 are spaced a predetermined distance apart with the first roll being vertical and the second roll being angled a predetermined distance from a vertical axis. Each roll is rotatable as indicated by arrows C. After leaving the second set of rolls 26, the traveling strand 12 is advanced for further processing which includes winding on a conventional bobbin 32.

According to the method of the present invention, dye 16 is metered onto the traveling strand 12 using the metering unit 14 with the dye being substantially absorbed by the strand 12. The strand 12 is then wound around the first set of rolls 18 with the strand being wrapped firstly around the downstream roll 22 to return to a wrapping engagement with the upstream roll 20 and then extending back toward the downstream roll 22, a sequence which is repeated several times before the strand 12 exits the first heating assembly 18. During it stay with the first heating assembly 18, the strand 12 is heated to a temperature of approximately 90° C. which causes the water in the aqueous dye solution to be removed without flashing to steam. After the traveling strand 12 exits the first set of rolls 18, its state is characterized by the presence of dye absent the water. The dye 16 is therefore ready for further thermal processing by the second roll assembly 26.

The strand is wound around the downstream roll 30 of the pair and then extends between the pair into a wrapping engagement with the upstream roll 28 of the pair. This wrapping and extension arrangement is repeated for a predetermined number of wraps, all the while the traveling strand 12 being heated within a range of 120° C. to 220° C., the exact temperature being dependent on the nature of the dye 16. After sufficient contact with the second heated pair of rolls 26, the traveling strand is then caused to move further downstream where it is wound on a conventional bobbin 32.

Figure 2:
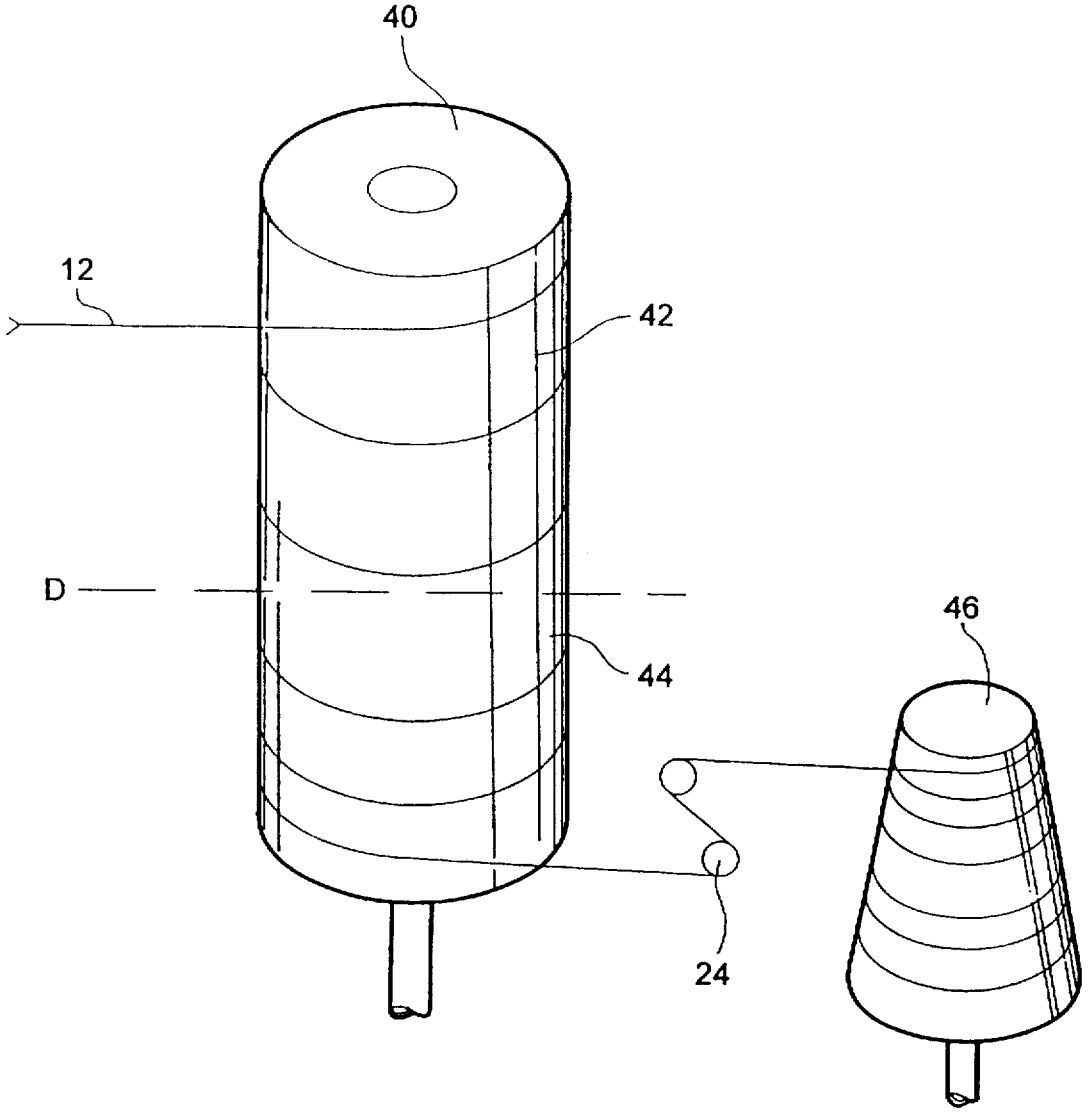
FIG. 2 is a diagrammatic view of an apparatus for carrying out the method according to a second preferred embodiment of the present invention.

According to a second preferred embodiment of the present invention, and with reference to FIG. 2, the heating arrangements may be combined in the form of a single zoned roll illustrated at 40. The zoned roll 40 is formed as a rotatably mounted cylinder and includes a first heating zone 42 indicated above line D in FIG. 2. A second heating zone 44 is provided and is indicated in the region below line D in FIG. 2. The traveling yarn 12 exits the zoned roll 40 and extends over the necessary pulleys 24 for ultimately winding on a bobbin 46 in a known manner.

According to the method of the present invention, the yarn 12 enters the zoned roll 40 in the first heating zone 42 and is heated to a temperature of less than 100° C. so that the water in the dye will slowly dry in a manner previously described. After the traveling yarn 12 exits the first heating zone 42 it enters the second heating zone 44 where it is heated to a temperature within the range of 120° C. to 250° C. as previously described.

By the above, the present invention provides a method for treating traveling textile strands which are dyed with an aqueous dye such that the water can be removed from the dye without causing an ultimately unsightly splattering effect on the strand.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for dyeing a traveling textile strand comprising the steps of:

providing a traveling textile strand moving along a predetermined travel path;

providing means for applying a liquid to the traveling strand;

applying the liquid to the traveling strand using the applying means;

providing first means for heating the traveling strand to a first predetermined temperature;

heating the traveling strand to the first predetermined temperature using the first heating means;

providing second means for heating the traveling strand to a second predetermined temperature, the second heating means being disposed adjacent to and downstream of the first heating means;

directing the traveling strand from the first heating means next to the second heating means;

heating the traveling strand to the second predetermined temperature using the second heating means;

directing the traveling strand from the second heating means next to a bobbin disposed adjacent to and downstream of the second heating means at an end of the travel path, and winding the traveling strand on the bobbin to form a finished package.

2. A method for dyeing a traveling textile strand according to claim 1 wherein the first means for heating includes a first pair of heated rolls disposed in opposition to one another with the traveling strand being trained around both rolls to extend therebetween.

3. A method for dyeing a traveling textile strand according to claim 2 wherein the second means for heating includes a second pair of heated rolls disposed in opposition to one another with the traveling strand extending from the first set of rolls next to the second set of rolls and being trained around both rolls of the second set to extend therebetween.

4. A method for dyeing a traveling textile strand according to claim 1 wherein said step of heating to a first predetermined temperature includes heating to a temperature less than 100° C.

5. A method for dyeing a traveling textile strand according to claim 1 wherein said step of heating to a second predetermined temperature includes heating to a temperature greater than 100° C.

6. A method for dyeing a traveling textile strand according to claim 1 wherein said step of applying a liquid includes applying an aqueous dye to the traveling strand by metering the aqueous dye onto the traveling strand whereby the traveling strand absorbs substantially all the dye applied thereto.

7. A method for dyeing a traveling textile strand according to claim 1 wherein said steps of providing first and second means for heating include providing a single roll having a first heating zone which is heated to a temperature less than 100° C. and a second heating zone which is heated to a temperature within the range of 120° C. to 250° C. with the traveling strand being trained around the roll in the first heating zone and then around the roll in the second heating zone.

8. A method for dyeing a traveling textile strand of yarn comprising the steps of:

providing a traveling textile strand of yarn moving along a predetermined travel path at a predetermined speed;

providing means for applying an aqueous dye to the yarn;

applying the aqueous dye to the yarn using the means for applying dye by metering the aqueous dye onto the traveling strand in coordination with the predetermined speed of the traveling strand so that the strand absorbs substantially all the dye applied thereto as it travels by a dye application position along the travel path;

providing means for heating the yarn to a first predetermined temperature less than 100° C., and means for heating the yarn to a second predetermined temperature greater than 100° C., the second heating means being disposed adjacent to and downstream of the first heating means;

heating the yarn to the first predetermined temperature using the first heating means;

directing the traveling yarn from the first heating means next to the second heating means;

heating the yarn to the second predetermined temperature using the second heating means;

directing the traveling yarn from the second heating means next to a bobbin; and winding the yarn on the bobbin to form a finished wound yarn package ready for sewing.

9. A method for dyeing a traveling textile strand of yarn according to claim 8 wherein said step of heating the yarn to a first predetermined temperature includes heating the yarn to a temperature of 90° C.

10. A method for dyeing a traveling textile strand of yarn according to claim 8 wherein said step of heating the yarn to a second predetermined temperature includes heating the yarn to a temperature in the range of 120° C. to 250° C.

11. A method for dyeing a traveling strand of textile yarn comprising the steps of:

providing a traveling strand of textile yarn moving along a predetermined travel path at a predetermined speed;

providing means for applying an aqueous dye to the yarn;

applying the aqueous dye to the yarn using the means for applying dye;

providing first means for heating the yarn to a first predetermined temperature less than 100° C.;

heating the yarn to the first predetermined temperature using the first heating means;

providing second means for heating the yarn to a second predetermined temperature greater than 100° C., the second heating means being disposed immediately downstream of the first heating means;

directing the traveling yarn immediately to the second heating means from the first heating means;

heating the yarn to the second predetermined temperature using the second heating means; and winding the yarn on a bobbin immediately after heating the yarn using the second heating means.

12. A method for dyeing a traveling strand of textile yarn according to claim 11 wherein said step of providing first means for heating the yarn includes providing two heated rolls disposed in opposition to one another with the yarn being trained around both rolls to extend therebetween.

13. A method for dyeing a traveling strand of textile yarn according to claim 12 wherein said step of providing second means for heating the yarn includes providing two second heated rolls disposed in opposition to one another with the yarn extending from the first yarn rolls and being trained around both second rolls to extend therebetween.

14. A method for dyeing a traveling strand of textile yarn according to claim 11 wherein said step of heating the yarn to a first predetermined temperature includes heating the yarn to a temperature of 90° C.

15. A method for dyeing a traveling strand of textile yarn according to claim 11 wherein said step of heating the yarn to a second predetermined temperature includes heating the yarn to a temperature in the range of 120° C. to 250° C.

16. A method for dyeing a traveling strand of textile yarn according to claim 11 wherein said step of applying an aqueous dye to the traveling strand includes metering the aqueous dye onto the traveling strand in coordination with the predetermined speed of the traveling strand so that the strand absorbs substantially all the dye applied thereto as it travels by a dye application position along the travel path.

17. A method for dyeing a traveling strand of textile yarn according to claim 11 wherein said steps of providing first and second means for heating the yarn includes providing a single roll having a first heating zone which is heated to a temperature less than 100° C. and a second heating zone which is heated to a temperature within the range of 120° C. to 250° C. with a yarn being trained therearound in both zones.

18. A method for dyeing a traveling textile strand of textile yarn comprising the steps of:

providing a traveling strand of textile yarn moving along a predetermined travel path at a predetermined speed;

providing means for applying an aqueous dye to the yarn;

applying the aqueous dye to the yarn using the means for applying dye by metering the aqueous dye onto the traveling strand in coordination with the predetermined speed of the traveling strand so that the strand absorbs substantially all the dye applied thereto as it travels by a dye application position along the travel path;

providing first means for heating the yarn to a first predetermined temperature less than 100° C., the first means for heating the yarn including two first heated rolls disposed in opposition to one another with the yarn being trained around both rolls to extend therebetween;

heating the yarn to the first predetermined temperature using the first heating means;

providing second means for heating the yarn to a second predetermined temperature, the second predetermined temperature being greater than 100° C., the second heating means being disposed immediately downstream of the first heating means and including two second heated rolls disposed in opposition to one another with the yarn extending from the first rolls and being trained around both second rolls to extend therebetween;

directing the traveling yarn immediately to the second heating means from the first heating means;

heating the yarn to the second predetermined temperature using the second heating means; and winding the yarn on a bobbin.

19. A method for dyeing a traveling strand of textile yarn according to claim 18 wherein said step of heating the yarn to a first predetermined temperature includes heating the yarn to a temperature of 90° C.

20. A method for dyeing a traveling strand of textile yarn according to claim 18 wherein said step of heating the yarn to a second predetermined temperature includes heating the yarn to a temperature in the range of 120° C. to 250° C.

* * * * *